US005297793A

United States Patent [19]

DeMar et al.

[11] Patent Number: 5,297,793

[45] Date of Patent: Mar. 29, 1994

[54] AUTOMATIC FLIPPER CONTROL CIRCUIT FOR PINBALL GAMES

[75] Inventors: Lawrence E. DeMar, Winnetka; Patrick Lawlor, Marengo, both of Ill.

[73] Assignee: Williams Electronics Games, Inc., Chicago, Ill.

[21] Appl. No.: 983,684

[22] Filed: Dec. 1, 1992

Related U.S. Application Data

[63] Continuation-in-part of Ser. No. 841,402, Feb. 25, 1992, abandoned.

[51] Int. Cl.[5] ..... A63F 7/30; A63F 9/24

[52] U.S. Cl. ..... 273/129 V; 273/129 R; 273/121 A; 273/119 R

[58] Field of Search ..... 273/118 R, 119 R, 120 A, 273/121 A, 124 A, 129 R, 129 V, 129 W, 119 A

[56] References Cited

U.S. PATENT DOCUMENTS

| | | | |
|---|---|---|---|
| 4,438,928 | 3/1984 | Wiczer | 273/129 V |
| 4,971,323 | 11/1990 | Gottlieb | 273/129 V |
| 5,131,654 | 7/1992 | Gottlieb et al. | 273/129 V |

OTHER PUBLICATIONS

"Pinball Machines Grow Smarter", EDN, Jan. 1978 vol. 23 No. 1, pp. 16-20.

*Primary Examiner*—Jessica J. Harrison

*Attorney, Agent, or Firm*—Rockey, Rifkin and Ryther

[57] ABSTRACT

A flipper control circuit is disclosed in which at least one flipper is controlled by the game microprocessor which attempts to hit a desired target. The processor activates the flipper in response to playfield sensors which detect the ball in proximity to the flipper. Playfield switches provide feedback to the processor on the accuracy of the shot allowing the processor to correct its "aim" for subsequent shots.

16 Claims, 17 Drawing Sheets

AUTOMATIC FLIPPER CONTROL CIRCUIT FOR PINBALL GAMES

CROSS REFERENCE TO RELATED APPLICATION

This application is a continuation-in-part of application Ser. No. 07/841,402 filed Feb. 25, 1992, now abandoned.

BACKGROUND OF THE INVENTION

This invention relates to pinball games in general and to methods and apparatus for actuating flippers in particular. As is well known in the pinball art, flippers are pivotally-mounted members positioned on the game playfield to enable players to hold, and/or redirect steel game balls while in play on the game playing field. A flipper must be capable of delivering sufficient force to propel a steel ball under dynamic conditions, that is, while both the ball and flipper are in motion as well as supporting the ball to position it for a shot. In this latter "static" state, the flipper is activated or energized, but neither the flipper nor ball are in motion.

Traditionally, flippers have been actuated by the player operating a flipper switch located on the side of the pinball cabinet. When closed, the switch completes an electric circuit to a solenoid mechanism which is linked to the flipper. Movement of the solenoid rotates the flipper, causing it to propel the ball, or hold it on the flipper. When the flipper button is released, the solenoid is deactivated.

Examples of flipper solenoids and circuits are shown in prior art U.S. Pat. Nos. 4,790,536 to Deger and 4,384,716 to Powers and in application Ser. Number 579,782 to Coldebella assigned to the present assignee. In Deger, a solenoid having two parallel coils are employed. Both coils are used to achieve the first power level, while only one coil is used for holding purposes. In Powers, a coil is fully activated for the power stroke and then power to the solenoid is decreased by phase control in the manner of a light dimmer.

In the Coldebella application, the flipper assembly disclosed in Deger is augmented with "slip detect" and timer circuitry to reenergize the flipper in the event that the ball striking the flipper causes it to slip from its fully energized position.

All of these disclosures are concerned with enhancing the operation of the flipper to improve player appeal. In particular, they increase the force of the flipper, maintain the flipper in an extended position and prevent slippage, while at the same time preventing overheating of the solenoid which would occur if full power was applied to the solenoid for long periods. In each case, however, the flipper is directly controlled by the player through operation of a flipper switch.

According to the present invention, it is desired to interpose the game microprocessor between the player and the flippers. This provides a number of advantages not found in the prior art. First, the processor can monitor the flipper coil operation and, if necessary, intercede to prevent overheating. This also improves flipper power by reducing power loss since only low voltage signal lines run from the player operated flipper buttons to the processor.

Controlling the flippers with the game processor provides additional advantages however, including the possibility of permitting the processor to activate one or more flippers independently of the player. This can be used as a reward to the player for making a difficult shot, to assist an inexperienced player or simply to create a unique playfield attraction. More specifically, the game processor can be programmed to attempt to make a difficult flipper shot using feedback from playfield sensors (switches). The processor can "learn" and improve its aim much to the amazement and satisfaction of game players.

Accordingly, it is an object of the present invention to provide an automatic flipper control circuit in which the game micro-processor controls actuation of the flippers to enhance player appeal.

It is a further object of the invention to provide apparatus in which game software is able to control flipper actuation, therefore to permit the player and/or the game software to enable or disable all or selected ones of the flippers.

These and other objects of the invention will become apparent to those skilled in the art from the detailed description of the invention provided below.

SUMMARY OF THE INVENTION

According to the present invention, the flippers on a pinball game are controlled by the game micro-processor rather than directly by the player. In one mode, the player operates a traditional flipper switch. This switch, however, is not in the power circuit for the solenoid rather, it merely signals the micro-processor. The micro-processor, according to the game software causes flipper operation. In some case, the flippers will be operated whenever the player so requests. In addition, the processor can be programmed to actuate the flippers without a player request, as for example, as a reward for achieving a certain score or making a bank of targets. Or, the processor can activate the flippers to attempt a "skill shot" and improve its "aim" by feedback from playfield switches which indicate if the ball hit a desired target.

DETAILED DESCRIPTION

Figure 1:
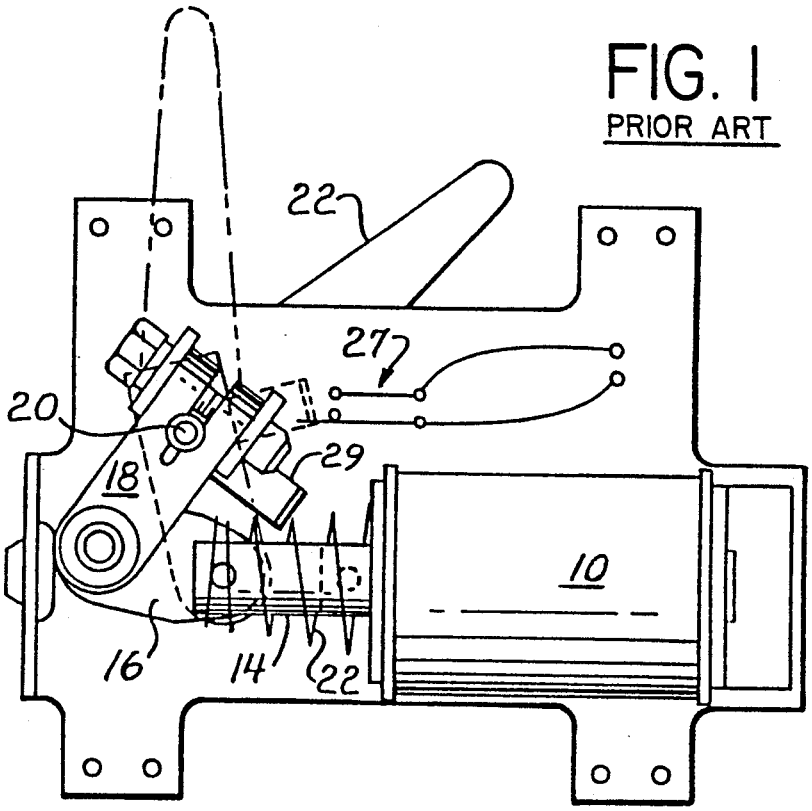
FIG. 1 PRIOR ART
FIG. 1 is a bottom plan view of a typical flipper assembly suitable for use with the present invention.

Referring to FIG. 1, a typical flipper mechanism is illustrated in a bottom plan view. A solenoid 10 is secured to support 12 and includes a retractable plunger 14. Linkage 16, 18 is pivotally connected to plunger 14 such that the linear reciprocating motion of the plunger is translated into rotational motion of a shaft 20. A compression spring 22 is disposed coaxially over plunger 14 to return the plunger to its extended position upon deactivation of the solenoid 10. Shaft 20 extends above the playfield and has the flipper member 22 secured thereto for rotation as illustrated in phantom.

An EOS switch 27 (which may be an optical, contact or similar switch) is fixed to support 12. Linkage 18 carries a member 29 extending therefrom such that EOS switch 27 can detect the fully actuated position of the flipper 22 shown in phantom. Should the flipper "slip" from the phantom position, this is signalled by EOS switch 27 as detailed in patent application Ser. No. 579,782.

Figure 2:
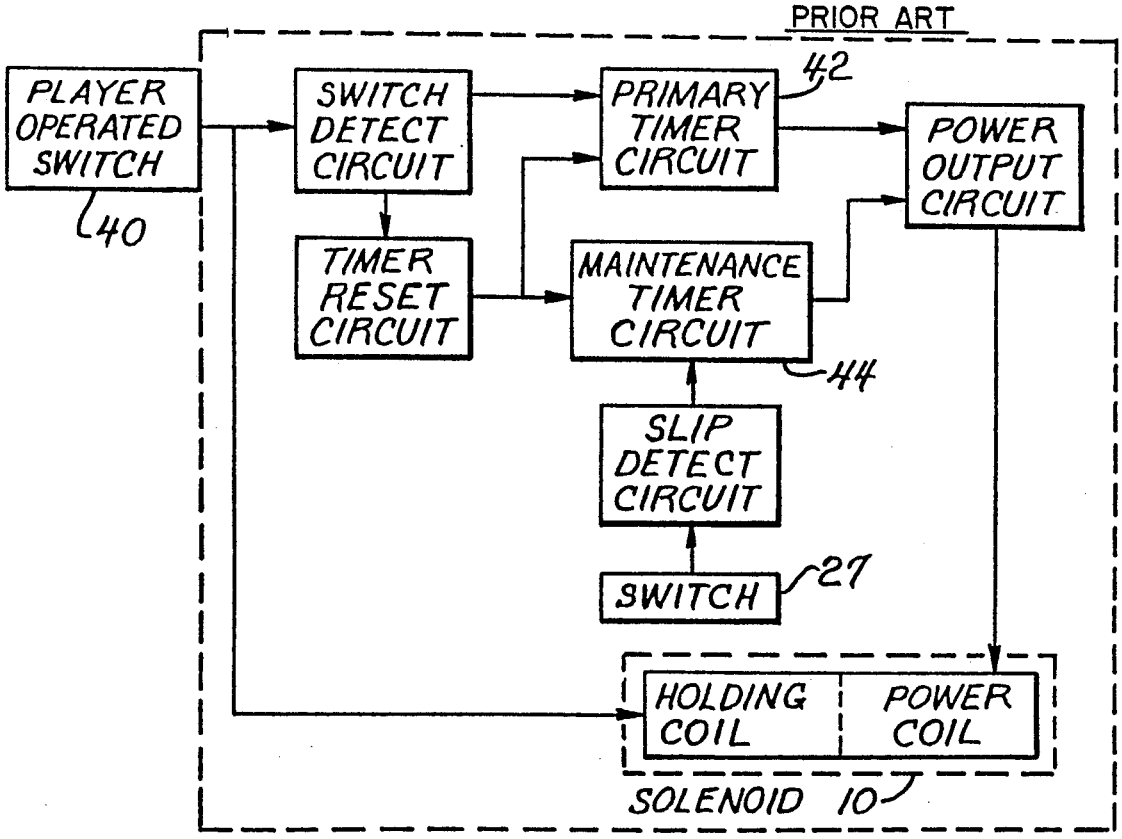
FIG. 2 PRIOR ART
FIG. 2 is a block diagram of a typical prior art circuit for operating a flipper solenoid.

Referring to FIG. 2, a block diagram of a prior art flipper circuit is illustrated. This circuit is disclosed and claimed in pending U.S. patent application Ser. No. 579,782 assigned to the present assignee and incorporated hereby. In general, the FIG. 2 circuit actuates the solenoid 10 in response to the player operated flipper switch 40. When the switch is closed, a holding coil and a power coil are simultaneously energized providing maximum power to the solenoid. After a period of time determined by a timer circuit 42, the power coil is deactivated leaving only the holding coil engaged. In the event that the EOS switch 27 detects slippage of the flipper, the power coil is briefly reenergized for a time period determined by the maintenance timer circuit 44. Operation of this circuit is described in additional detail in the referenced patent application.

It should be noted that the flipper assembly and circuitry of FIGS. 1 and 2 do not involve the game microprocessor. In contrast, the present invention employs different circuitry and permits the micro-processor, under the control of the game program, to operate one or more flippers. This is shown in block form in FIG. 3.

Figure 3:
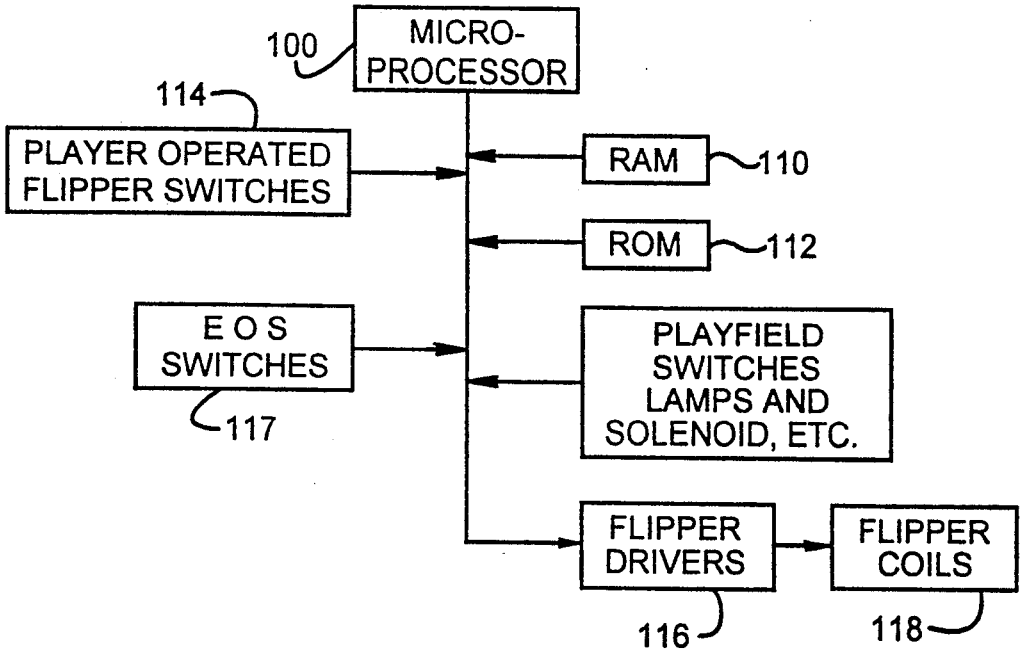
FIG. 3 is a block diagram of a game system suitable for use with the present invention.

Referring to FIG. 3 game processor 100 is interconnected by a bus in the usual manner to RAM memory 110 and ROM memory 112. In addition, the bus permits communication between the processor and the various playfield switches, solenoids, lights and displays. In the case of the present invention, it also communicates with flipper switches 114 and flipper solenoid drivers 116 to operate the flipper solenoid coils 118.

As is known to those skilled in this art, the game processor typically controls the scoring and operation of the lights and displays as a function of the game software which is stored in the ROM memory 112. The game software responds to playfield switch closures causing the award of points, operation of lights and displays, actuation of playfield solenoids and similar devices. The RAM memory 110 is the processor's working memory in which current game data is stored and manipulated.

The processor also communicates with one or more player operated flipper switches 114, traditionally located on the sides of the pinball game cabinet. The processor 100, upon receiving a signal that one or both flipper switches have been closed will normally activate the appropriate flipper solenoid drivers 116. The fully activated flipper position is then detected by EOS switch 117. Activation, however, is subject to the program contained in the memories 110 and 112. According to the present invention it is also contemplated that the processor will operate the flipper drivers 116 without receiving a signal from the flipper switches 114.

Specifically, the game designer may program the processor to control operation of selected flippers or other ball propelling means, such as slingshots or kickers, independently of the player. This provides an entirely new dimension of creativity by permitting: (1) handicapping of players by selectively disabling one or more flippers in a multi-flipper game; (2) activation of flippers without player input in order to assist players who are less skillful, or to reward a player for achieving certain game objectives; (3) an "attract model, for pinball games where the game demonstrates a particular shot off the flippers; (4) the processor attempting a difficult shot and using "feedback" from the playfield switches to improve its aim.

Figure 4:
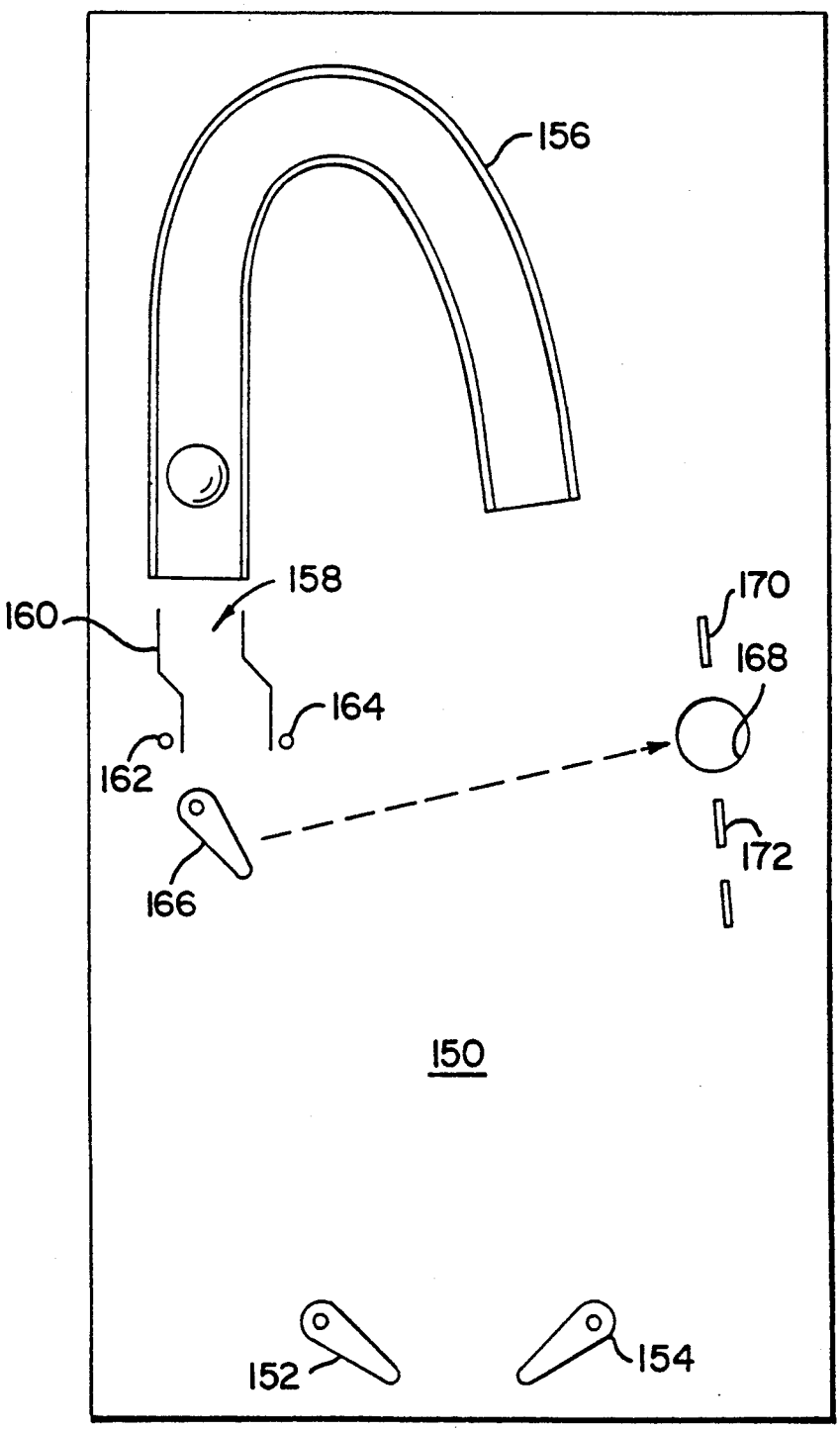
FIG. 4 is a plan view of a pinball playfield illustrating one aspect of the invention.

Referring to FIG. 4, an embodiment of the invention in the context of a typical pinball game is illustrated. Shown is a playfield 150 having a plurality of playfield features disposed thereon. At the lower end of the playfield are a pair of flippers 152, 154 which are typically player controlled. According to the illustrated embodiment, disposed on the upper portion of the playfield is a ramp 156 at which the player is to direct the pinball using the flippers 152, 154. The ramp serves two functions. First it requires the player to exercise skill to direct the ball at the ramp in order to "make" the shot. Second, once on the ramp, the ball is delivered to a specific location on the playfield at which a computer controlled flipper or other ball propelling device can shoot the ball. The exit end of the ramp is at 158, the entrance to ball guides 160, which may be a wireform or other suitable element for directing the ball to a secondary flipper 166. Disposed on either side of ball guide 160 are detector elements 162, 164. These elements preferably comprise optical semi-conductors such as on a LED and a photodetector. Other detector elements may be used (such as magnetic switches, micro-switches, transistor switches etc.). The optical elements are provided to detect the ball passing through the ball guide 160. The velocity of the ball is measured as a function of the time the opto is interrupted. This information is provided to the processor via the bus of FIG. 3 which then initiates operation of secondary flipper 166.

In a typical application, the flipper will be operated in an effort to make a skill shot as, for example, to propel the ball across the playfield to a selected location. In the case of the illustrated embodiment, the selected location is an opening or drop-hole 168 located on the far side of the playfield. The opening may lead to other portions of the playfield and presumably would result in the award of a large bonus score or other result as may be desired by the game designer. On either side of hole 168 are targets 170 and 172. As will be apparent, if the computer controlled flipper shot is too high, the ball will strike target 170. Similarly, if a shot is too low, it will strike target 172. Striking target 170 or 172 activates an associated switch, the operation of which is signalled to the micro-processor as indicated in connection with the description of FIG. 3. Thus, each time the processor operates flipper 166 in an effort to make the drop-hole shot, it will subsequently determine the success of this effort by detecting whether a switch associated with the drop-hole has been activated or whether one of the targets 170, 172, has been struck by the ball, or whether the shot was missed altogether. In this way, the processor can "learn" to aim more accurately. If the shot is constantly too high, the processor will increase the delay time before operating the flipper to, in effect, lower its aim. The reverse is true if the shot is too low.

This feature of the invention has a number of practical advantages. Although the processor can quickly learn to make a shot, rolling ball games are often moved from location to location by operators and are also subject to rough handling. Depending upon the angle of the playfield at a new location, the correct timing to make a shot will change. In addition, as a game ages the flipper solenoid will gradually lose power, also requiring adjustment to the flipper firing time in order to make the shot. Because the processor continually monitors the results of its shots, it can alter operation of the flipper as necessary to maintain accuracy.

An important aspect of making a shot is the initial velocity of the ball as it reaches the flipper 166. In the illustrated embodiment, a ramp is used to provide some control of the ball velocity as it reaches the flipper. Nevertheless it may vary significantly. The configuration of the ball guide 160 (note the jog) can also help to ensure relatively constant velocity of the ball as it moves into position on the flipper. Information about ball location and speed is provided to the processor from the optical sensors 162–64. These sensors will signal when the ball first interrupts the sensors. The duration of the interruption is a function of ball velocity. This period can be used by the processor to calculate ball velocity and to adjust operation of the flipper 166 accordingly. Thus, for example, a slowly traveling ball will cause the processor to delay operation of the flipper 166 somewhat longer than a ball moving at a higher speed.

The embodiment illustrated in FIG. 4 is simply one of many applications wherein a processor controlled flipper can be used to increase player interest in a game. Obviously it is not necessary to provide a ramp, nor is the ball gate 160 required. Simply put, the advantages of the present invention are the ability of the processor: (1) to detect that the ball is in the proximity of a flipper; (2) to know the speed of the ball as it approaches the flipper; (3) to receive feedback indicating the accuracy of a desired shot by the processor controlled flipper; and (4) to adjust its "aim" as a result.

From these principles many interesting playfield arrangements can be conceived. For example, the player can be given an opportunity to operate flipper 166 and compete against the processor in a "shoot out". Or, the ball could be held stationary or released adjacent the flipper and the player given an opportunity to attempt a difficult shot. If the player fails to attempt the shot or misses repeatedly, the processor can attempt the shot for him. Many other variations, using the principals of the invention are possible.

As indicated previously, processor control of the flipper can also be used for an active demonstration of the game to encourage game play, something not now practical in rolling ball games but which is used quite effectively in the attract mode of video games. Also, other entertainment use is possible such as flipping the flippers in time to the game music.

The preferred software implementation of the invention is a three parameter system. The system continuously monitors the average ball speed through the optos (opto delay). A delay sample is measured anytime the opto is triggered by a ball. The interrupt logic will compute a new opto delay sample. Parameter one is the average ball speed past the optos. The flipper is operated using this average ball speed to compute a time delay before flipping (parameter 2) for the average ball speed using a drunk walk algorithm. The delay that is determined by this drunk walk is parameter two. For each time unit above or below the average ball time, the delay time is adjusted by multiplication with a constant or delay scalar (which is parameter 3). The program then monitors hits/misses and adjusts accordingly. Hits/misses for ball velocities which significantly deviate from the average ball speed are used to adjust this "delay scalar" parameter. Hits/misses for ball velocity which are near the average are used to adjust the time delay for average ball speed (parameter 2).

The IRQ interrupt is responsible for measuring the ball speed past the optos and, if appropriate, flipping the flipper. As soon as a ramp switch signals that a ball is coming, it sets the opto measurement flag. The IRQ starts in state 0 which is idle.

The setting of the opto measurement flag starts a time down during which the opto measurement will be honored. Waiting for the ball to interrupt the optos 164 is state one. A timeout returns to state zero. When the optos close, state two begins for timing the interval that the ball interrupts the optos. Upon entering state two, the flipper 166 is removed from player control, if the automatic flipper feature is engaged.

When the ball passes the optos, we have the ball time. The program computes the flip delay time and enters state three where it times down the computed delay before flipping the flipper. Once the delay time has timed out, state four occurs to flip the flipper and time down the flipper activation time. Once the flipper activation time has expired, the flipper is turned off and its control is given back to the player, returning to state zero.

Preferably, when a game is first installed, the automatic flipper is disabled until an average ball speed is available. The game enters a "quick-learn model, which varies the delay parameter until the flipper hits the intended target. This ends "quick learn" and begins use of the "regular learning algorithm". "Quick learn" is reestablished if the regular algorithm gets five consecutive flips that hit nothing.

Figure 5:
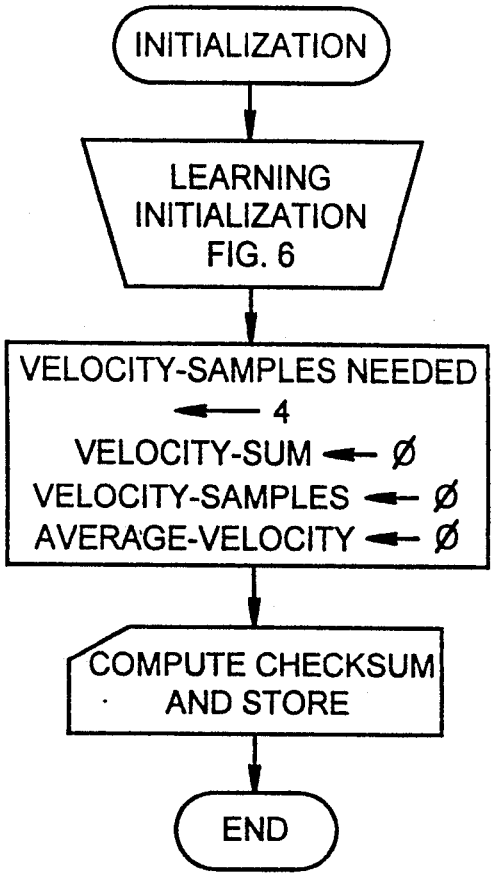
FIG. 5, 5*a*, 6, 7*a*, 7*b*, 7*c*, 8*a*, 8*b*, 9, 10, 11, 12, 13, 14*a*, 14*b*, 15*a* and 15*b* are flow diagrams useful in explaining operation of the invention.
Figure 6:
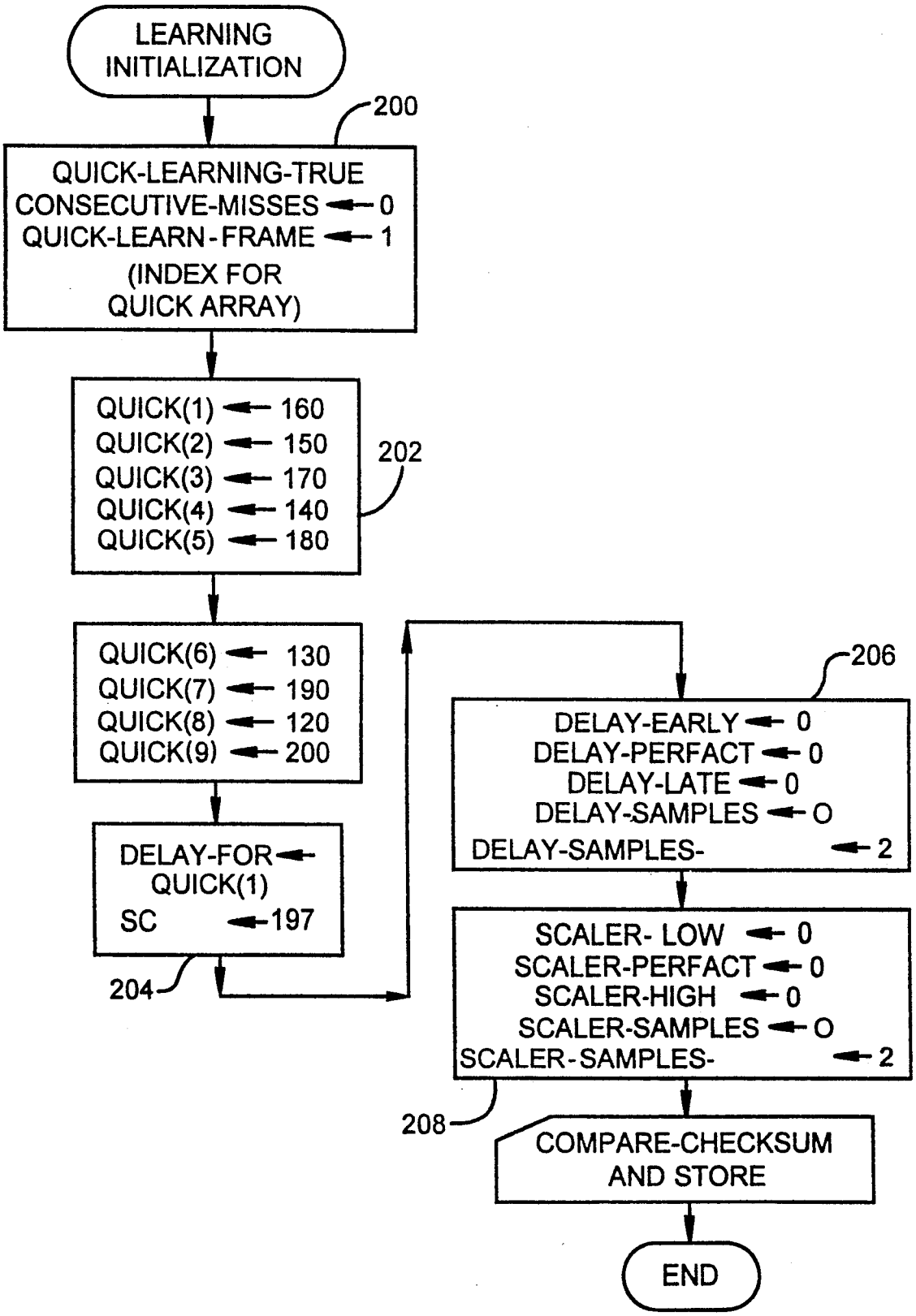

Referring to FIGS. 5 et seq., the software flow diagrams will be explained in sufficient detail to enable an ordinarily skilled programmer to implement routines for practicing the invention in any desired computing language. FIG. 5 illustrates the routine which occurs the first time a game operates or whenever the battery back-up fails or the game is reset. The initialization routine shown includes a learning initialization routine which is illustrated in FIG. 6. This is a called subroutine which establishes defaults for the scalar used to adjust for varying ball speed (parameter 3) and the average ball delay (parameter 2) variables. Next, the counters used in the various subroutines are set to their initial values. A check sum is computed and stored to ensure data validity and the routine ends.

Figure 5A:
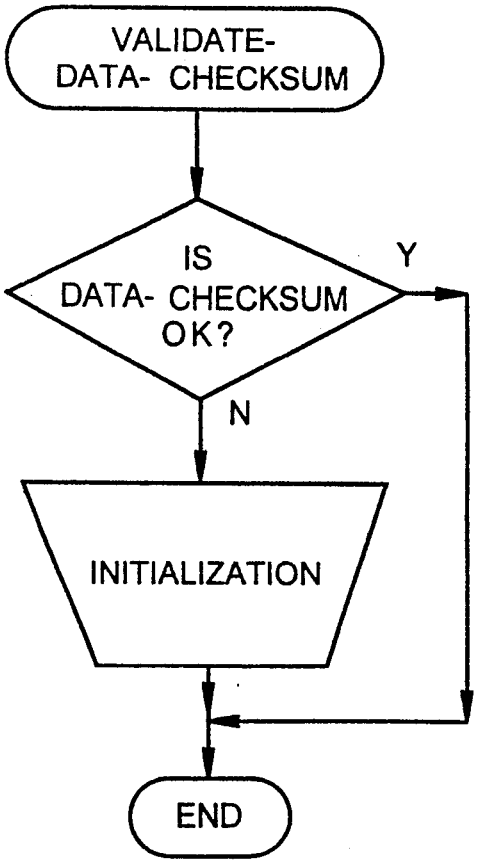

In FIG. 6 the learning initialization subroutine used when the game is first turned on or when an invalid checksum is detected (FIG. 5A) is illustrated. At 200 the "quick learn" routine is enabled and an index created for the "quick learn" array of values which are factory determined as being within a range reasonably to be expected. Thus, at 202, the subscripted variables Quick (1)–(5) are assigned the values 160, 150, 170, 140 and 180 respectively, representing delay values (in milliseconds) to try during the quick learn mode. Similarly Quick (6) through Quick (9) are additional values somewhat more removed from those to be expected. This drunk walk array will, in most cases, result in the game hitting proximity targets 170 and 172. The game will then make small adjustments to the "delay value" until it successfully makes the auto-flip shot. When this occurs, the game will use the value which successfully made the shot until it has enough samples to begin accurately computing values for its further calculations.

At 204 initial values for two of the key parameters used to calculate flipper delay time are set. Specifically, the delay time for average ball velocity is initially chosen to be the value of the variable Quick (1). A scalar is initially set to a factory determined value, in this case 197, where 197 represents the numerator of a fraction, the denominator of which is 256. The value 197 is changed as appropriate, as indicated hereafter, to adjust or scale the "delay for average" value for a faster or slower than average ball. Boxes 206 and 208 indicate the feedback counters and variable names used for maintaining track of the variables used by the regular algorithm. Finally, a check sum is computed and the routine ends.

Figure 7A:
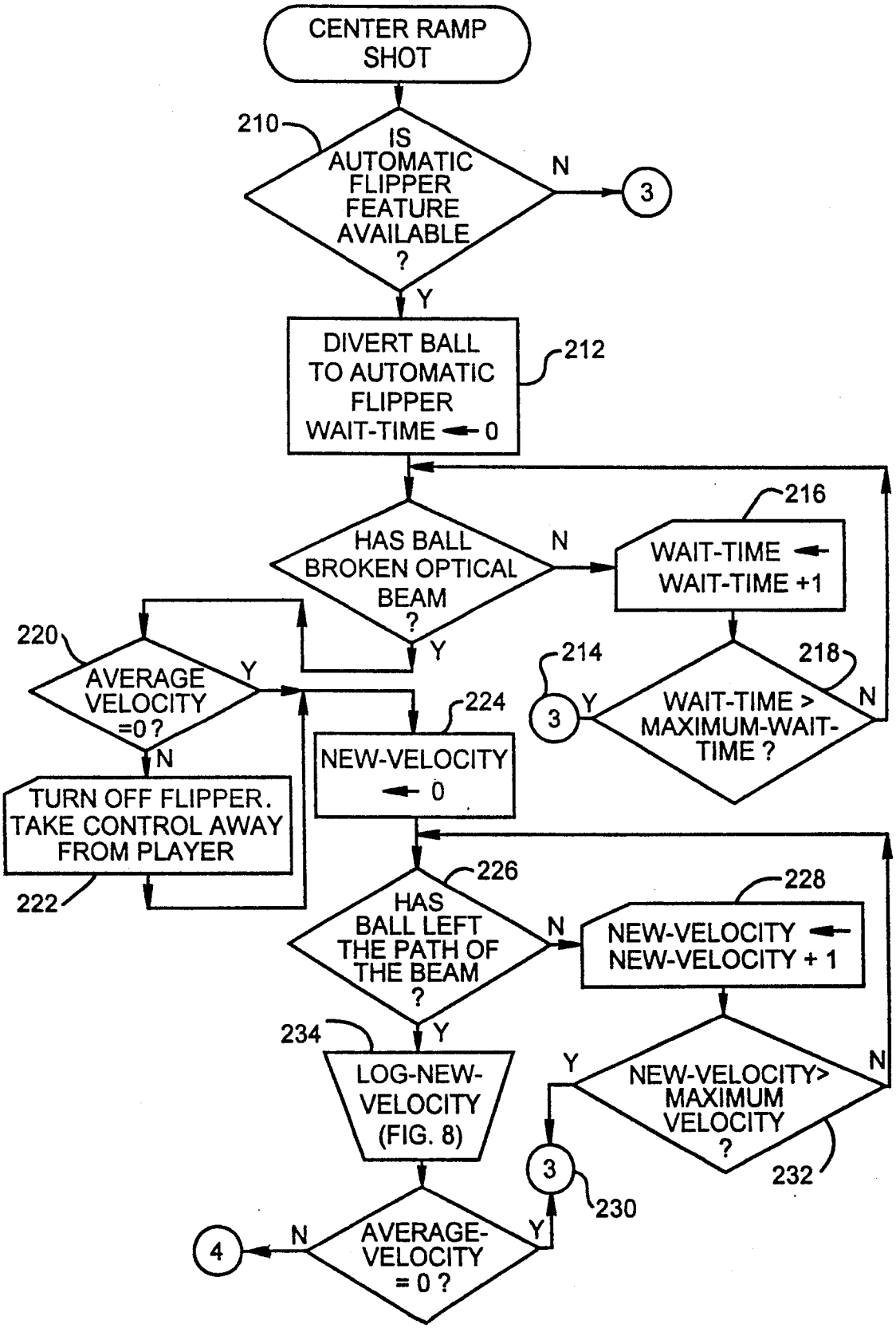

FIGS. 7A, B and C illustrate the "center ramp shot" subroutine which is employed during game play to enable and maintain data on the auto-flip feature. At 210 a check is made to determine if the automatic flip feature is enabled. If so, the wait timer initiates the time out count after which the system assumes that a false signal has been received. In such case the program branches to the end of the subroutine as indicated at 214 via 216 and 218.

Figure 7B:
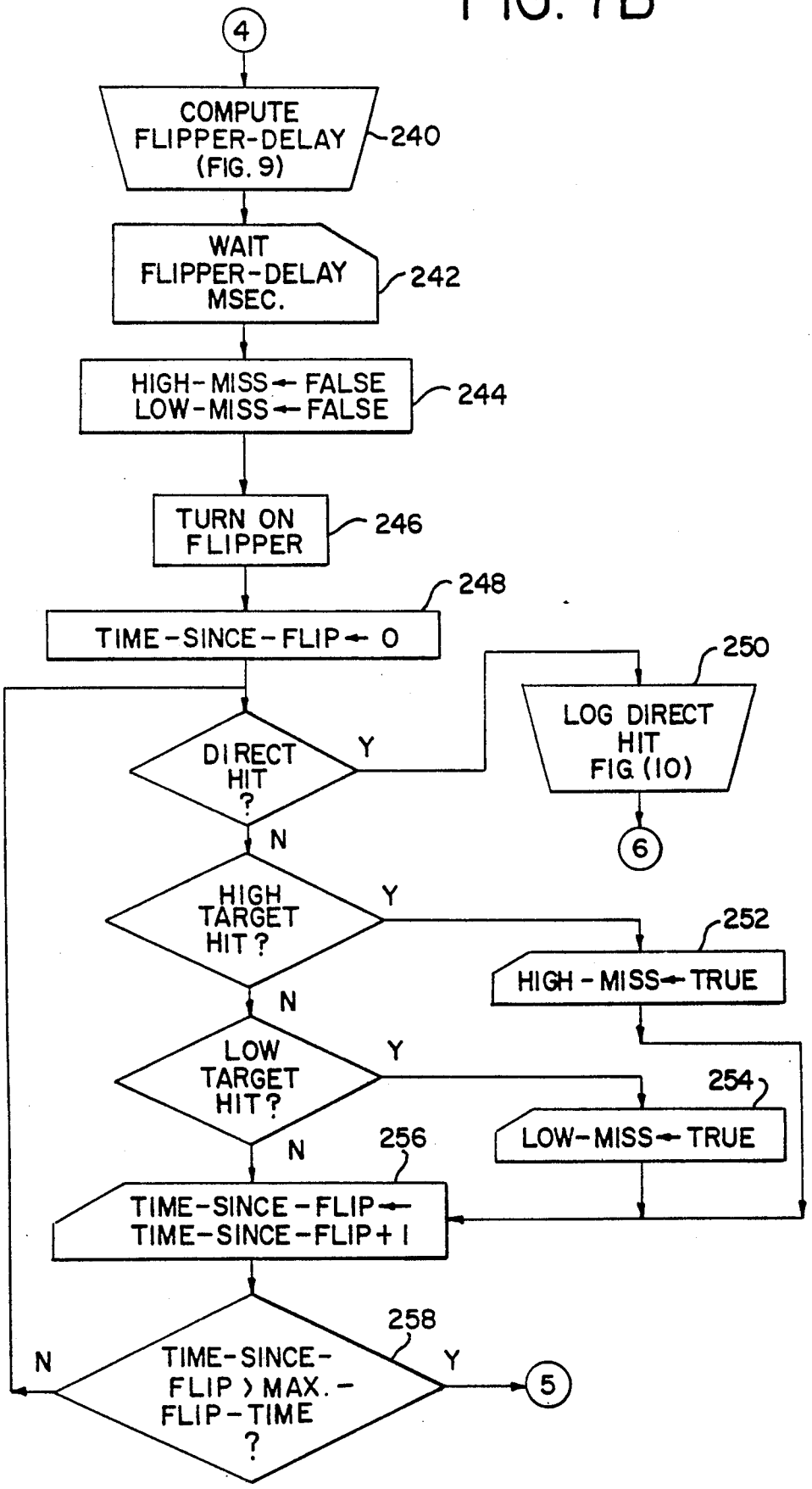

If the optos 162/164 detect a ball before time out a check is made to see if the average ball velocity is equal to zero, step 220. If so, this indicates that the system does not have a first approximation of the average ball velocity and therefore, no automatic flipping will occur. As a result, the flipper control remains with the player rather than with the micro-processor because the function specified in box 222 is skipped. Otherwise, step 222 takes control of the flipper away from the player and turns the flipper off so that it may be flipped by the micro-processor at the appropriate time. At 224, the variable "new velocity" it set equal to zero and then the program waits until the ball has left the path of the optical beam, step 226. Until this occurs, the variable "new velocity" is periodically incremented at 228 until the beam is no longer interrupted, or a maximum value is reached in which the case the routine terminates as indicated at 230. When the beam path is no longer broken, the value of the new velocity is logged at 234 for purposes described in connection with FIGS. 8A and B. If the average velocity is not equal to zero, the subroutine continues as indicated in FIG. 7B.

Figure 7C:
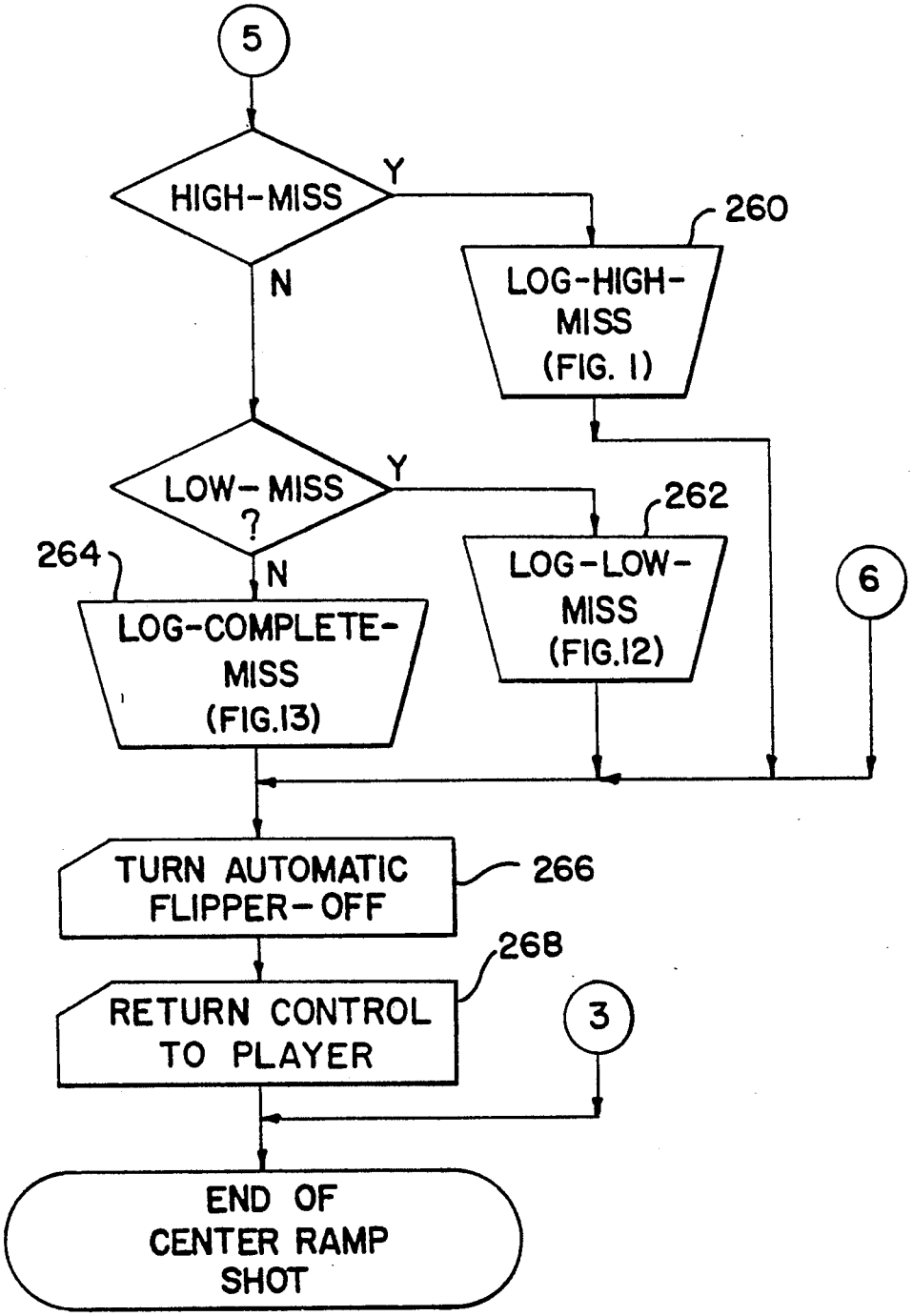
Figure 9:
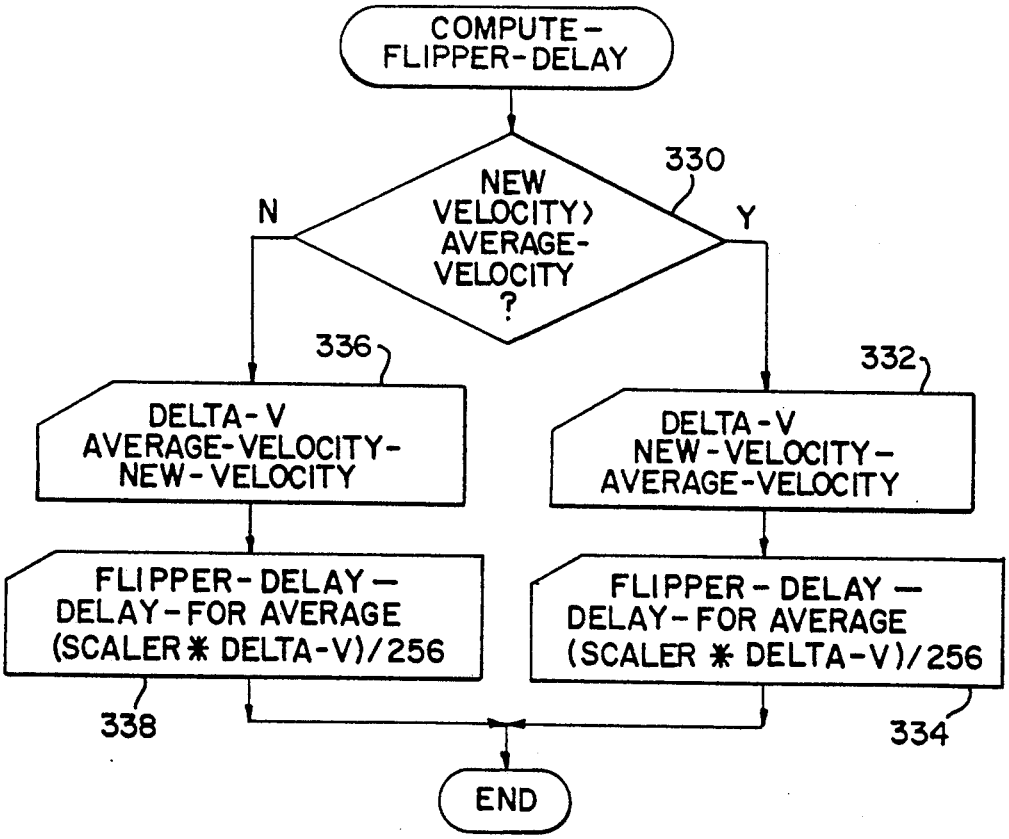

The flipper delay time is computed at 240 using the subroutine shown in FIG. 9. The program then pauses until the computed flipper delay has occurred 242. The variables "high miss" and "low miss" are reset at 244 and the flipper is turned on at the end of the flipper delay wait period, step 246. A timer 248 is then initialized. This timer limits the time for recognizing that the ball has struck or missed a target. The program then waits for feedback from the playfield. If a direct his is detected, the hit is logged at 250 using the subroutine shown in FIG. 10 after which the subroutine branches to 6 as shown in FIG. 7C. If a high target hit is detected, i.e., the target 170 above the drop-hole 168 in FIG. 4, the variable "high miss" is set, step 252. Alternatively, if the low target 172 is hit, the variable "low miss" is set, step 254. In any case, the timer is incremented at 256 and a check is made to determine if the maximum time has been exceeded at 258.

Figure 11:
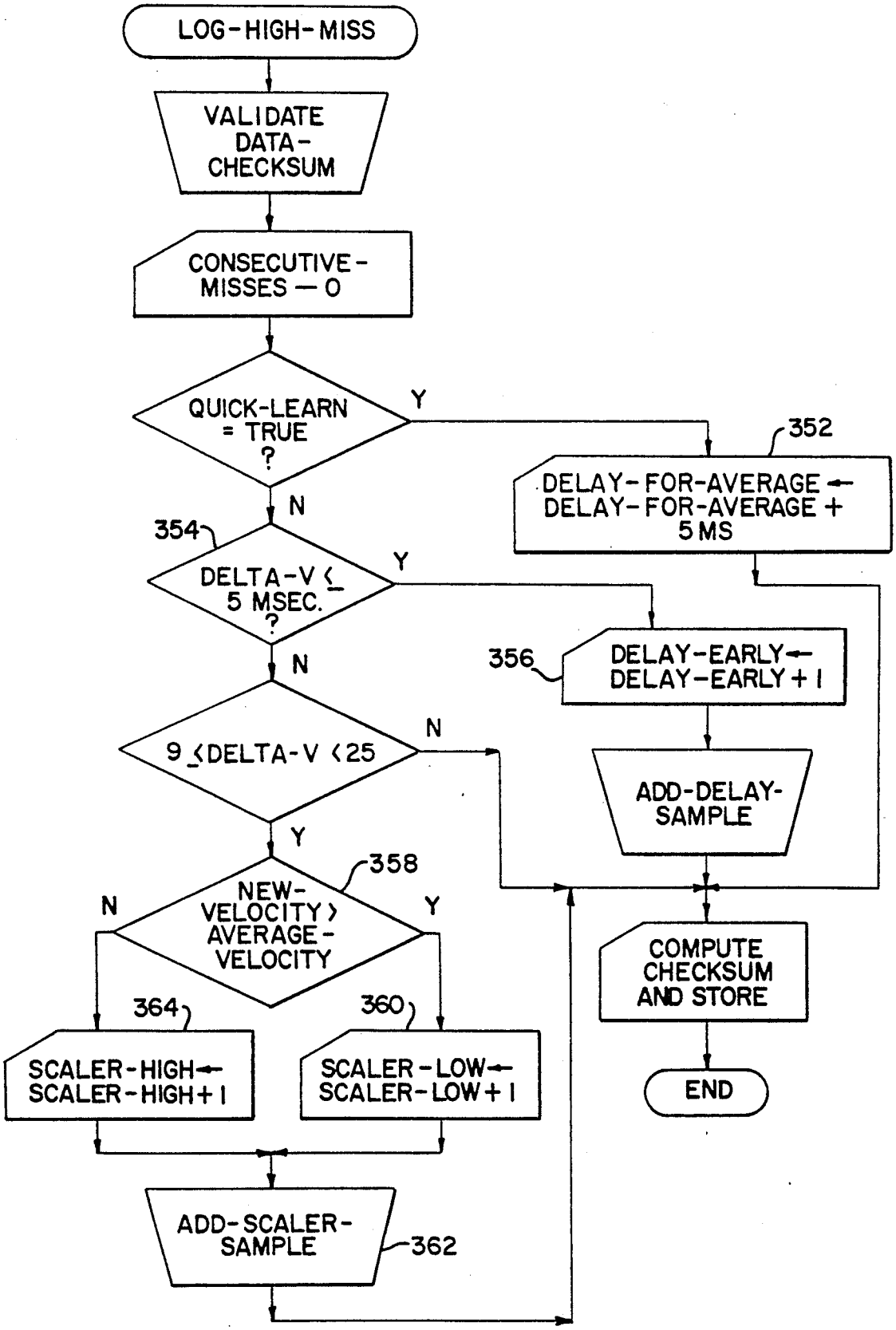
Figure 12:
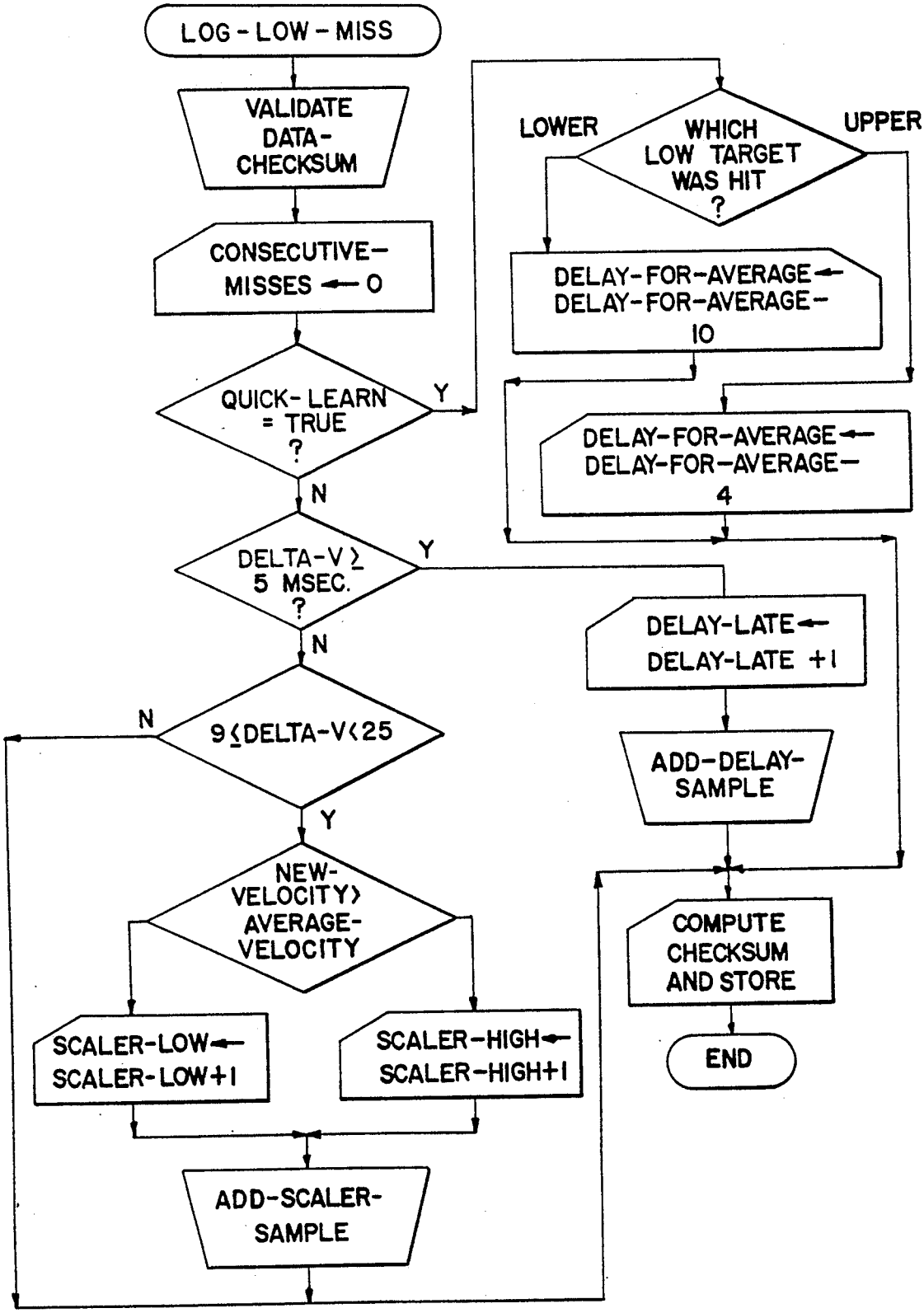

Referring to FIG. 7C, in the event of a high miss or a low miss that fact is logged at 260 or 262 respectively using the subroutine shown in FIGS. 11 and 12 respectively. In the event of a complete miss (the shot is off so far that it hits no targets associated with the automatic flipper) that fact is logged at 264 using the subroutine illustrated in FIG. 13. Thereafter the flipper is turned off and its control is returned to the player, steps 266 and 268. This ends the center shot ramp subroutine.

Figure 8A:
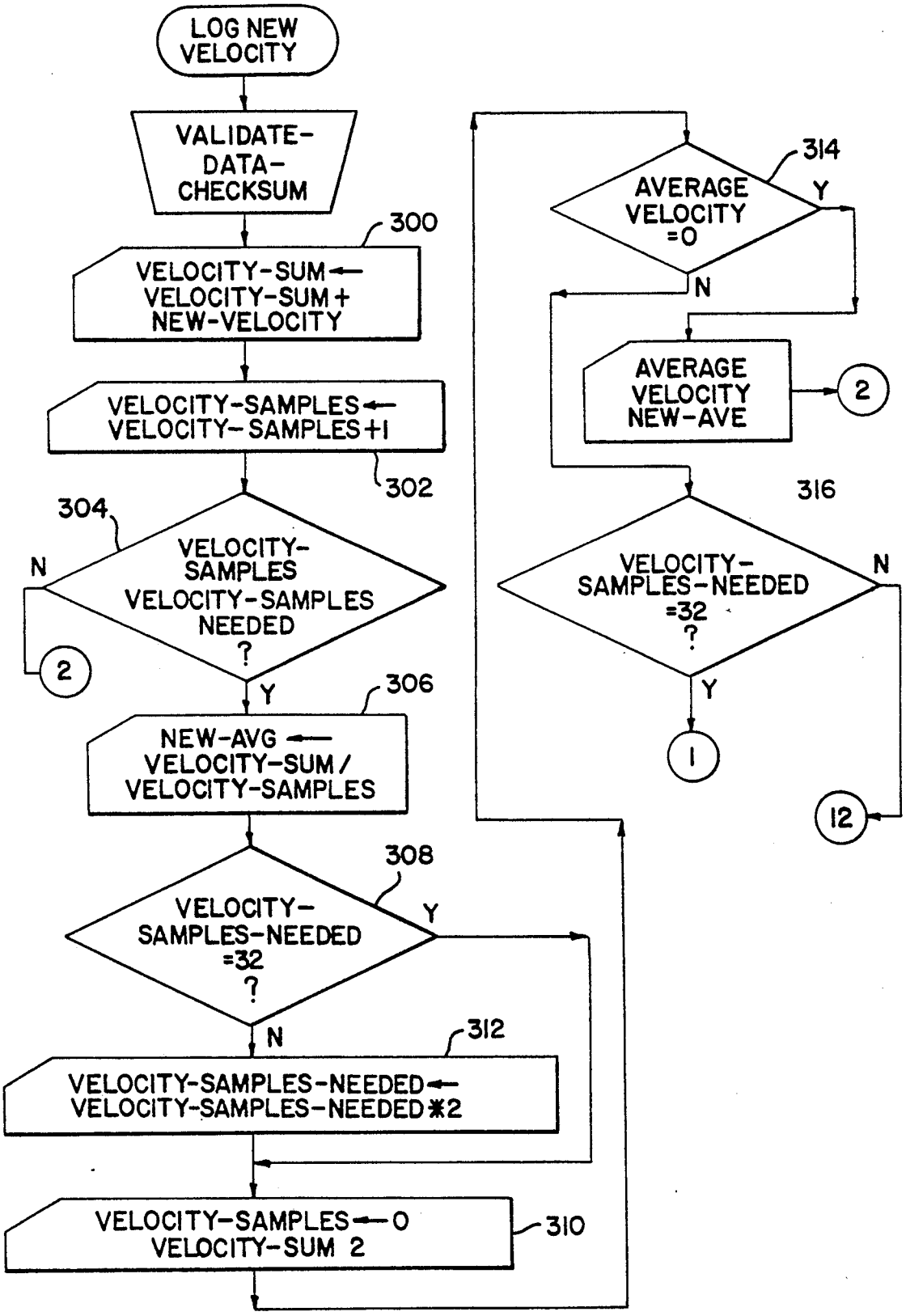

Referring to FIGS. 8A and B, the log new velocity subroutine is illustrated. Each time the ball is delivered to the automatic flipper ramp, a velocity measurement is made. This subroutine maintains a running average. At 300 the "velocity sum" variable is set equal to its previous value plus the new velocity obtained from FIG. 7A, step 234. A corresponding change is made to the number of velocity samples, step 302 and a check is made to determine if the number of samples equals the minimum required to calculate a new average, step 304. If not, the routine ends as indicated. If the number of samples is equal to the number desired, a new average is computed by dividing the "velocity sum" by the number of samples to obtain "new average", step 306.

A desirable feature of this subroutine is the ability to start with a low number of samples needed to calculate the average ball velocity and to increase the number of samples required up to a predetermined maximum. This allows quick initial determination of average velocity and then allows more and more samples to be used to increase accuracy. For illustrative purposes, the maximum number of samples is set at 32 as indicated at 308. Accordingly, a check is made to determine if we are at the maximum number of samples. If so, the subroutine branches to step 310. Otherwise, the number of velocity samples needed is doubled at step 312. It is desirable for the initial sample size to be a power of two, such as two, four or eight. This simplifies the division operation at 306. After computation of the new average ball velocity, the samples and velocity sums are zeroed out for the next period.

Figure 8B:
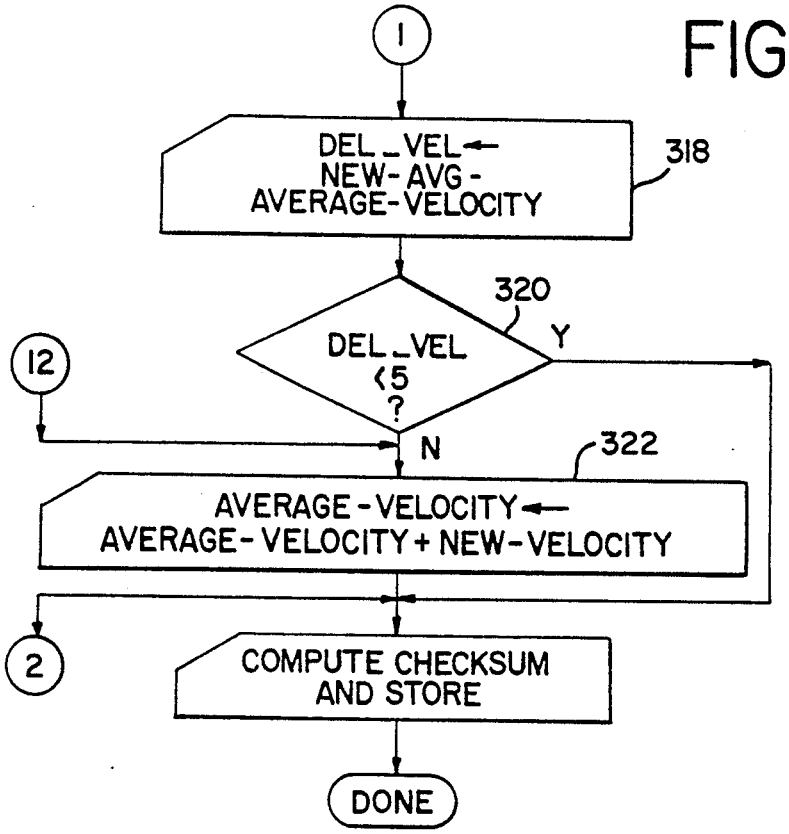

At 314, a check is made to see if the average velocity equals zero. If so, this indicates it is the first computation so the new average is stored as the average velocity at 316. If average velocity does not equal zero, a further check is made to determine if we are at the maximum number of samples, step 316. The result of this check tells us where in the learning cycle we are. Because the flipper logic is based on the average ball velocity, it is undesirable to make small average velocity changes in the long run. If sixteen or thirty-two samples have taken, small changes in average velocity are inhibited. Otherwise, small changes are permitted indicated in FIG. 8B. Where the number of samples is at 32, we inhibit small changes at steps 318 and 320. Otherwise, at 322, average velocity plus the new average value is divided by two to overdamp by averaging the old and new velocity values. After computing the check sum, the routine then terminates.

Referring to FIG. 9, a subroutine for computing the delay time before flipping the flipper is illustrated. Based on the period of time that the optos 162/164 are interrupted, the computer makes a determination as to whether the ball velocity is greater or less than the average ball velocity at 330. Note that in the flow chart the word "velocity" is defined and used in a different sense than normal. In reality, the tern "velocity" in FIG. 9 means the period during which the ball is in the opto beam, which is, of course, inversely related to ball velocity. A faster moving ball is in the beam for less time than a slower moving ball. Thus, if the new "velocity" is greater than the average, the ball is moving slower and it is necessary to flip the flippers later than the normal delay time. This is recognized at 332 where the "delta v" variable is set equal to the new (current ball) velocity minus the average velocity. The "delta v" variable is then multiplied by a scalar and added to the average delay to compute the new delay value which will be slightly greater than the average value, step 334. In the event that the ball is moving faster than average, the reverse steps are taken at 336 and 338 resulting in a shorter delay and therefore earlier operation of the automatic flipper.

In boxes 334 and 338, the flipper delay is computed by taking the average ball delay time and adding thereto or subtracting therefrom respectively, "delta v" times a scalar. As indicated earlier, the scalar is a fraction, the numerator of which may vary, the denominator of which is 256. The preferred factory setting according to the invention is 197/256 or about 0.77. As the system learns, the scalar can be modified by increasing or decreasing the numerator in order to establish a relatively linear correspondence between ball speed and delay period.

Figure 10:
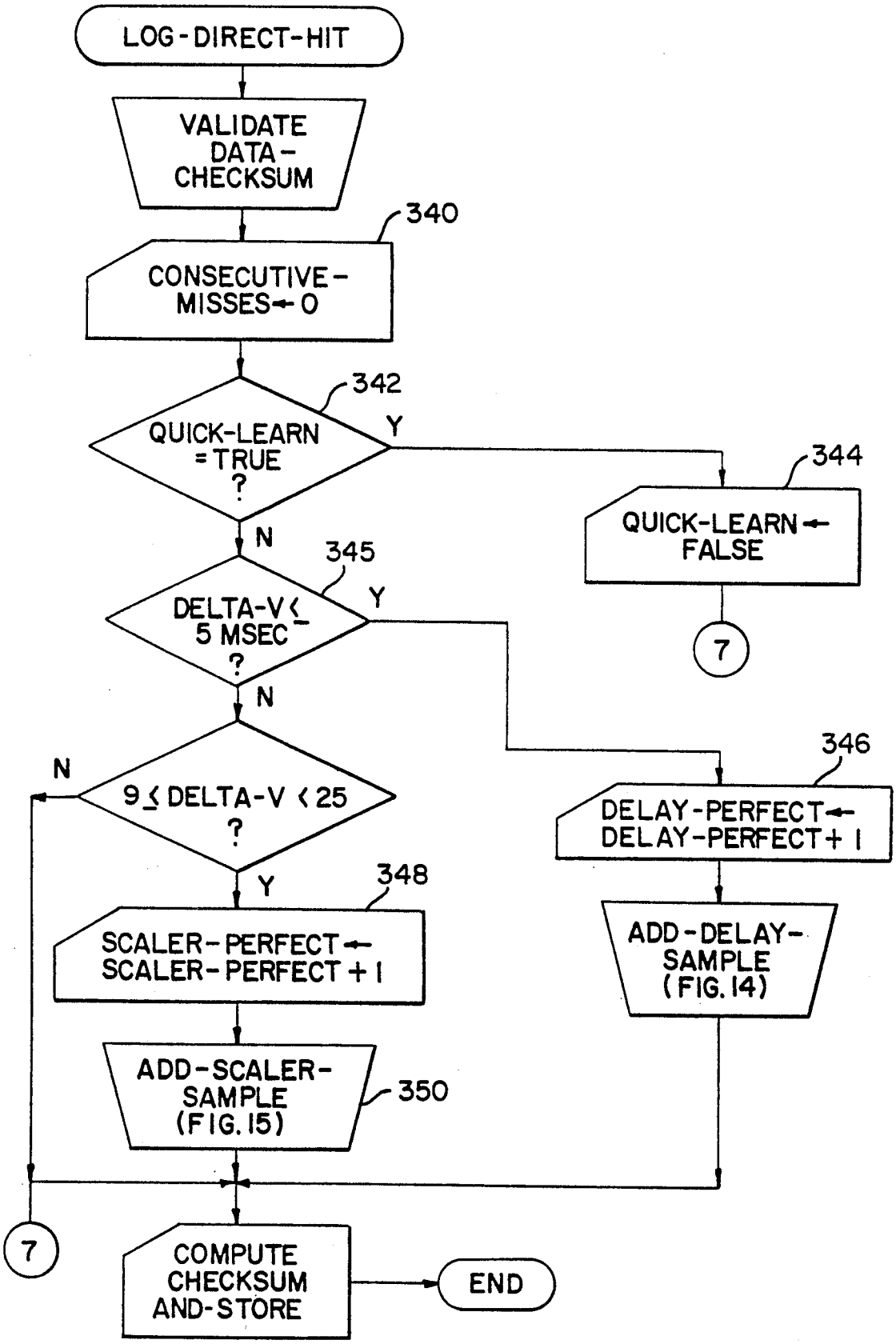

FIG. 10 is the subroutine for logging a direct hit, i.e., when the flipper correctly places a ball into the drop-hole 168. After validating the checksum, the variable "consecutive misses" is set to zero at 340 and if the program was in the "quick learn" mode, due to recent initialization, it is terminated at 342–344. When "quick learn" is over, the delay time for an average ball speed is updated by the regular learning process detailed previously in connection with FIG. 7A, B and C. At 345, the magnitude of the "delta v" variable (from FIG. 9) is examined. This variable is the absolute value of the difference between the current ball velocity and the average velocity. If its less than or equal to five milliseconds, for example, the program branches to 346 which increments the counter "delay perfect", adds the delay sample and thereafter terminates. This is because velocity was near the average so we use the data to update the "delay for average" ball parameter. If the value "delta v" is greater than five milliseconds, but between nine and twenty-five milliseconds (arbitrarily selected values) than the "scalar perfect" variable is incremented and the sample added at 348 and 350 for use in adjusting the scalar parameter. This is because the ball velocity was far from average, thus the scalar played a large factor in the flipper delay computation. In either case, the routine then ends.

FIG. 11 is the routine for logging a high miss, i.e. one which hits target 170 rather than going into the drop-hole 168. After validating the check sum, the consecutive misses is set to zero since a high miss is not considered a miss in the sense of not receiving any response to a flip of the ball. If "quick learn" is on, the program branches to 352 where an adjustment is made in the delay time for an average ball to compensate for the fact that the flipper flipped too soon. Accordingly, a longer delay time is desired and the "delay for average" variable is incremented by five milliseconds, an arbitrarily selected value. Thereafter, a check sum is computed, stored and the routine terminates.

If not in the "quick learn" mode the program branches to 354 where the value "delta v" is examined in the same way as explained in connection with FIG. 10. The right branch to 356 updates the data for the "delay early" variable and adds the sample before terminating. The left branch leads to a decision box at 358 to determine if the new ball velocity is greater than the average velocity. If it is, the "scalar low" counter is incremented at 360 and a sample added to the sample counter 362. Alternatively, the scalar high counter is incremented at 364. These data are used for adjusting the scalar (FIG. 15).

FIG. 12 is the "log low miss" routine and is identical in concept and implementation to the log high miss routine of FIG. 11 with one minor exception: there are two feedback targets on the playfield below the intended drop-hole, while there is only one target above the drop-hole. This difference, however, is trivial and the implementation is as described in connection with FIG. 11 in all other respects.

Figure 13:
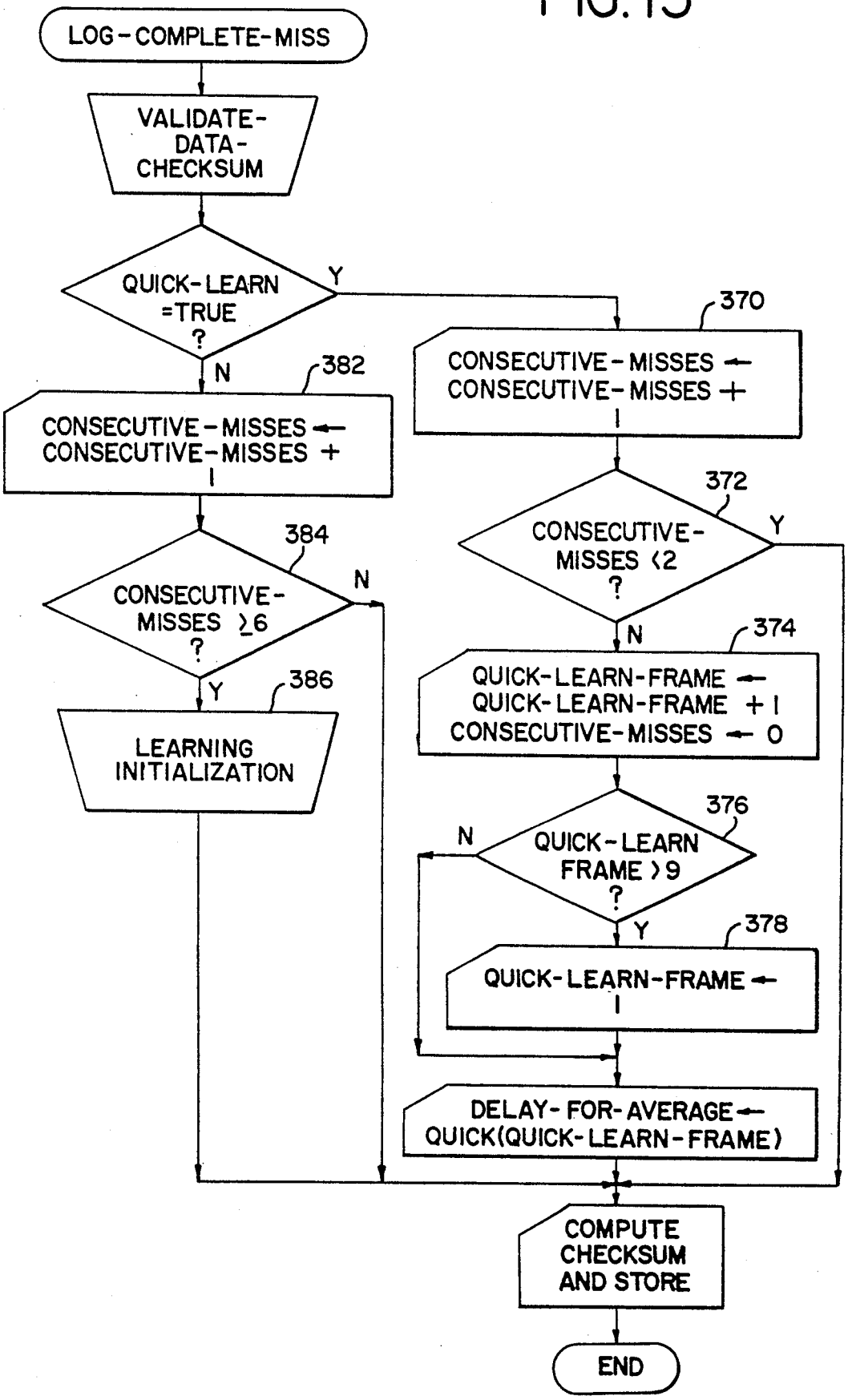

FIG. 13 logs a complete miss in which the ball does not hit any of the targets associated with the automatic flipping playfield feature. After a check sum calculation the "quick learn" mode is detected if on, in which case a branch to 370 occurs in which the variable "consecutive misses" is incremented. At 372 it is determined whether there have been two consecutive misses. If not, the routine ends. If so, at 374, a different "Q" value is selected from those described in connection with FIG. 6. For example, the value 160 ms would be used for two tries as shown at step 202 of FIG. 6, after which the value 150 ms would be tried, when step 374 is encountered after two misses. At 376 if all of the values have been tried the program returns to the initial values, step 378, otherwise at 380 the delay time for an average ball is selected to be the value Q from step 202 et seq. specified in FIG. 6.

If "quick learn" is off, the consecutive miss variable is incremented at 382 and if consecutive misses is greater than or equal to six at 384, learning initialization starts all over again at 386. This indicates that nothing has been hit for several shots, therefore something has been changed or altered on the playfield and the initialization process starts over.

Figure 14A:
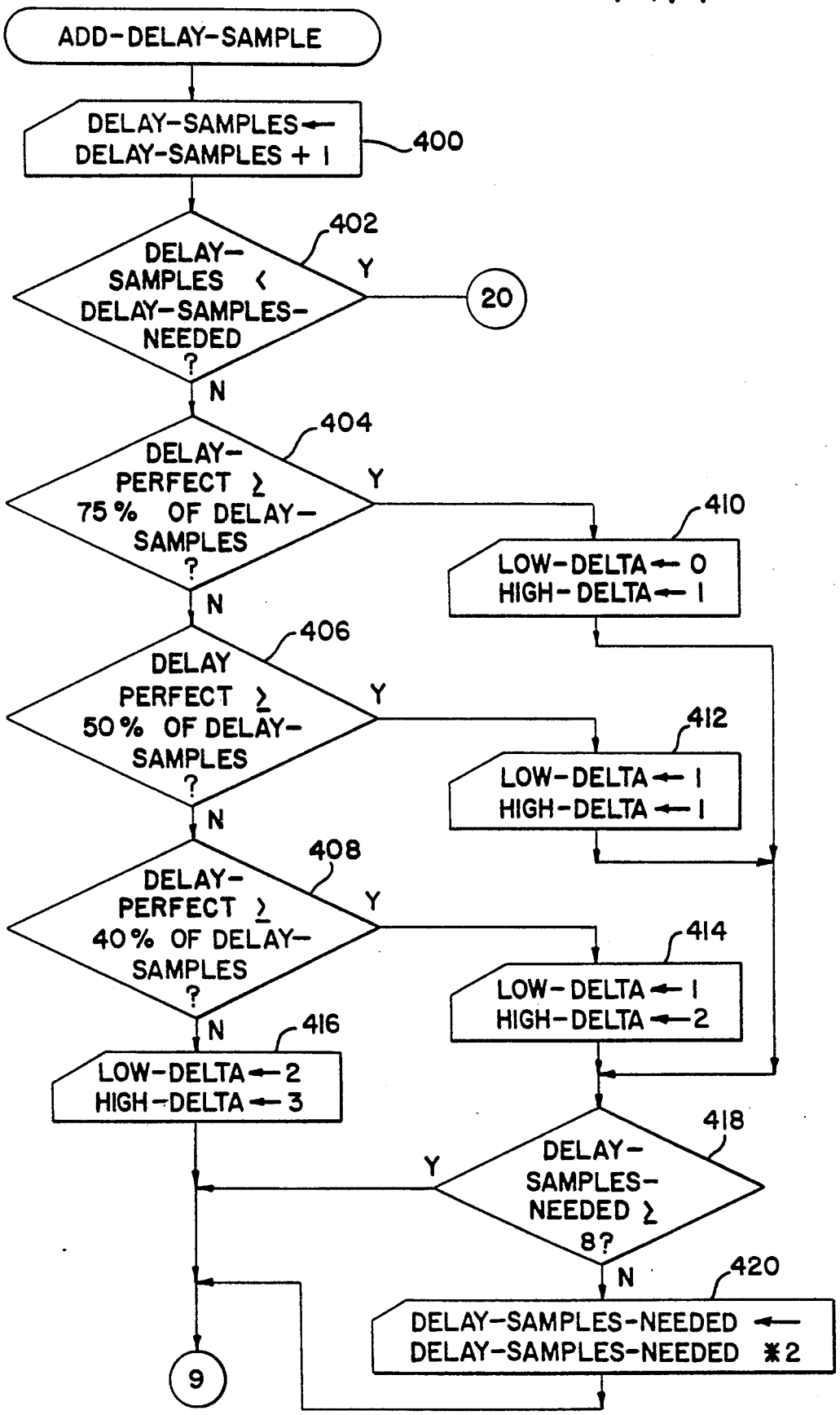

FIG. 14A and B constitute a subroutine for adding a delay sample for use in updating the delay period for flipping the automatic flipper. The "delay sample" variable is incremented each time this routine is called at 400. A determination is then made whether the delay sample variable is less than the number of samples required to update at step 402. If not, we have collected enough samples to modify the delay parameter and a series of decision boxes 404, 406 and 408 are encountered. These decision boxes determine the range of the collected samples causing the variables "low delta" and "high delta" to be set to numbers which reflect the result of the comparisons.

More specifically, when sufficient samples are available to permit recomputation of the delay period, the available samples are divided into three categories. "Delay perfect" (the ball went into the drop-hole), "delay early" (the ball hit the high target) and "delay late" (the ball hit the low target). At steps 404, 406 and 408, the data are categorized to determine what percent of the samples represent delay perfect, i.e., the ball went into the drop-hole. In the event that at least seventy-five percent of the samples were perfect, it is desired not to significantly change the delay period. Accordingly, at step 410, the variables "low delta" and "high delta", explained hereafter are arbitrarily selected to be zero in the case of "low delta" and one millisecond in the case of "high delta". If fifty percent or more, but less than seventy-five percent of the samples represent perfect shots, than a slightly greater adjustment to the variables "low delta" and "high delta" is made as indicated at box 412. In the event that between forty and fifty percent of the samples represent perfect delay, than the deltas are changed as shown at box 414. Finally, in the event that only a few samples, i.e., less than forty percent represent perfect shots, than the deltas are changed as shown as box 416.

The variables "low delta" and "high delta" represent the absolute difference between the number of early and late flips. Thus, for example, if eight samples are needed to recompute and five of the flips were early, three were perfect and none late, the delta value would be five (5−0). This would be interpreted as a "high delta" and accordingly, the larger adjustment indicated for the "high delta" values would be used in adjusting the delay period. Likewise, in the event that there is just a difference of one, for example, than the "low delta" value would be used for adjusting the delay period. Which set of low and high delta values are utilized is a function of the number of "delay perfect" samples in the group as indicated previously.

After determining the correct delta value to use, a check is made at 418 to determine if the number of samples needed has reached its maximum value. If not, the number of samples for the next computation is doubled at 420. The routine continues as shown in FIG. 14B.

Figure 14B:
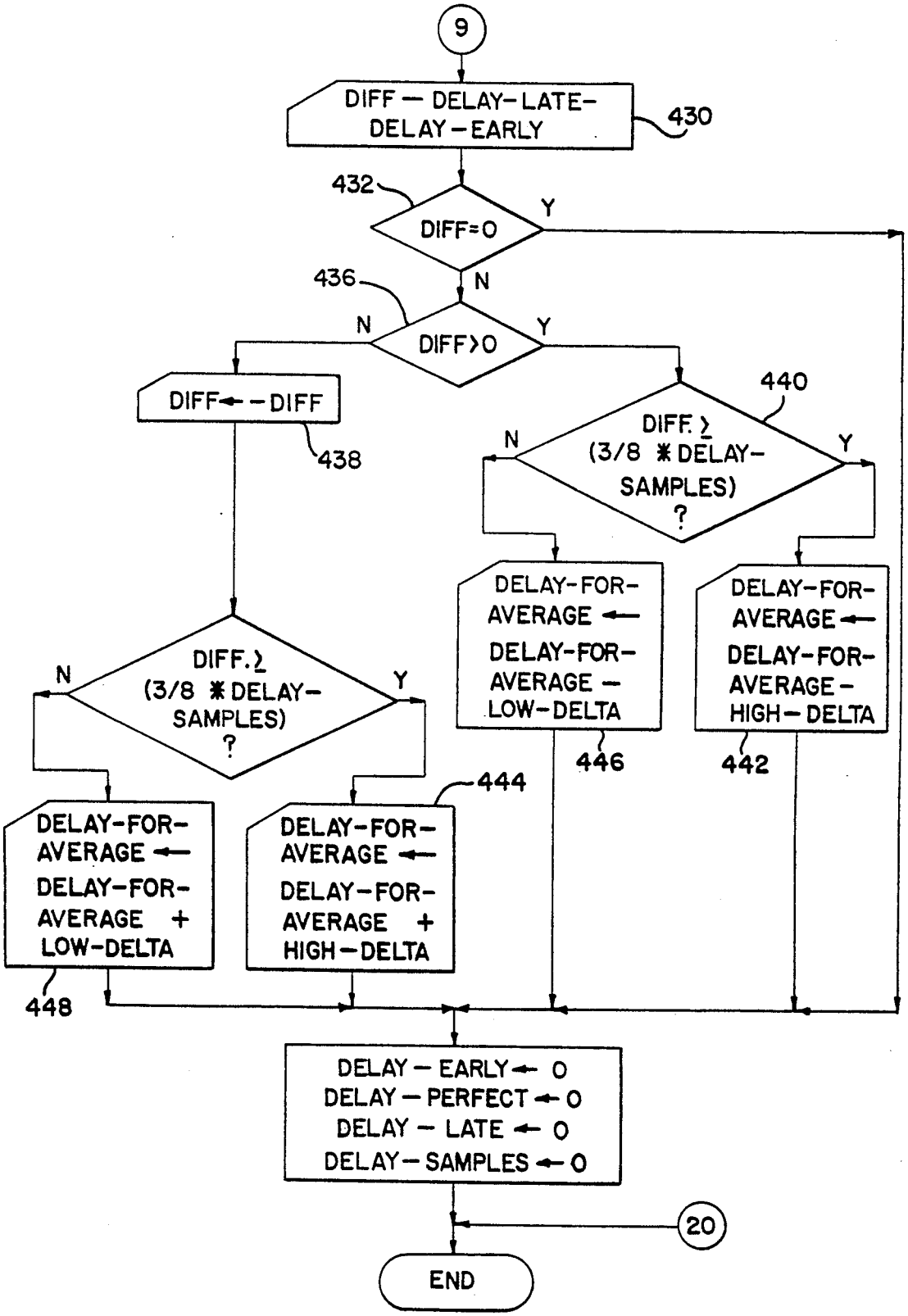

In FIG. 14B, the delta value selected is indicated as the variable "diff". At 430, "diff" (equal to the delay late minus the delay early samples) is tested to determine if the difference is zero, step 432. If so, the routine ends after resetting the variables indicated at 434. If the difference is not zero, step 436 is used to determine whether there are more shots that are late than early or vice versa. Depending upon the outcome, a branch is made either to box 438, in the event that the shots are too early and it is necessary to increase delay time, or to decision box 440 in the event that the shots are too late and it is necessary to decrease the delay. In either case, the processing thereafter is identical, but for the sign reversal which occurs at box 438.

If "diff" is greater than or equal to an arbitrarily selected fraction of the samples, in this case, three-eighths, than the "high delta" value is added or subtracted respectively to the delay for average value thereby to decrease the delay in the case of a late shot or to increase the delay in the case of an early shot. This occurs at steps 442 and 444 respectively. Similarly, if the "diff" variable is less than three-eighths of the delay samples, the "low delta" value is used for altering the delay for average variable as indicated at steps 446 and 448 respectively. Thereafter the routine ends.

In this way, whenever a sufficient number of samples have been collected, the data is analyzed to determine how many perfect shots have been made as well as how many high hits and low hits have occurred. If there is a significant discrepancy between the number of high hits and low hits ("high delta") than a greater adjustment is made to the delay time used for flipping the flipper. Conversely, a smaller delta value causes a less significant adjustment in the delay time. In this manner, the system constantly tracks the quality of the shots made and tends to maintain high accuracy by improving its aim as conditions on the playfield change over time. As indicated in connection with FIG. 15, the same analysis and learning capability is provided where the ball speed varies significantly from the average ball speed, so that the system constantly learns how to treat balls which are moving faster or slower than the average by adjusting the value of the scalar.

Figure 15A:
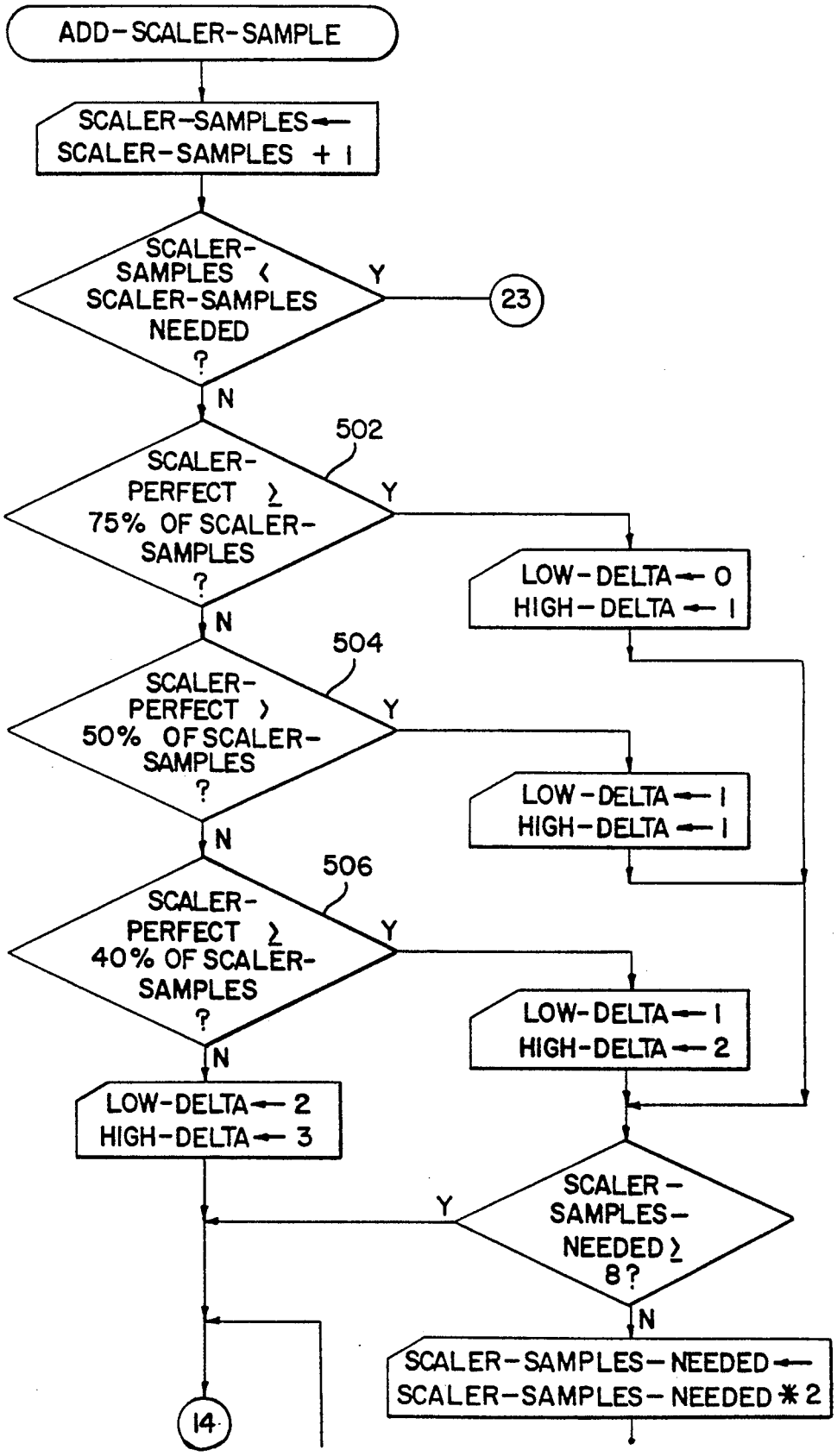
Figure 15B:
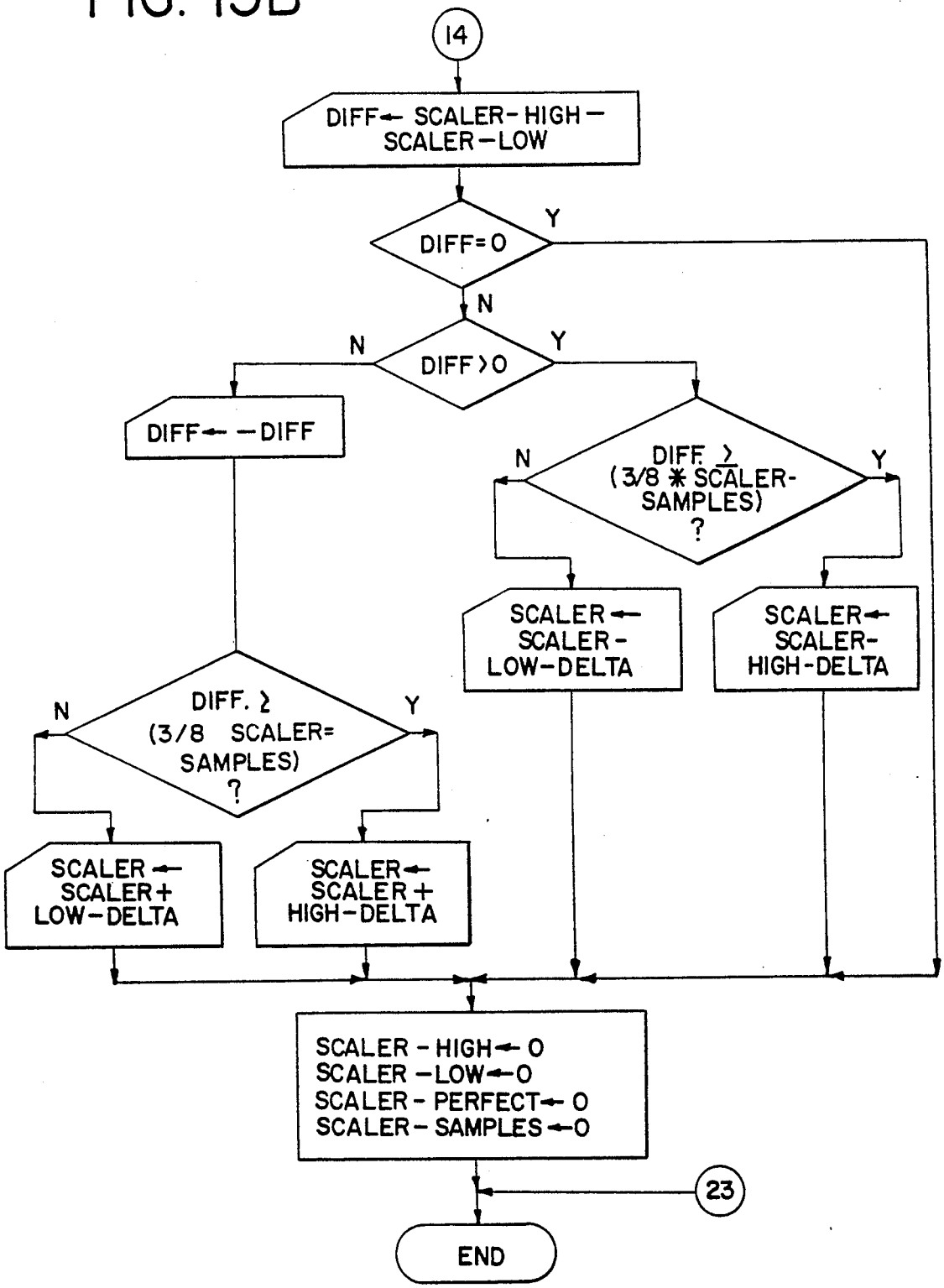

FIG. 15A and FIG. 15B constitute a subroutine for adding a scalar sample. The "scalar sample" variable is incremented and then it is determined whether the scalar samples are less than the needed number of samples. If they are, the program ends. If not, a series of decision boxes 502, 504 and 506 are encountered to permit analysis of the scalar data. In general, FIGS. 15A and B are similar to FIGS. 14A and B for the add delay sample. Accordingly, the description provided for FIGS. 14A and B applies to FIGS. 15A and B with simple substitution of variable names.

To further exemplify the manner in which the system operates, it must be recognized that there are two independent processes. First, it is necessary to compute the average velocity (where velocity is really the time in milliseconds required for the ball to travel through the optical beam). The second process is the learning process based on two parameters: (1) the computation and maintenance of the delay time required for the average ball; (2) the computation and use of a scalar for ball velocities other than the average.

By way of example, if the average ball velocity is assumed to be 120 milliseconds (the time it takes for the ball to clear the optical beam) then we can compute a delay before flipping time for the average ball based on the location of the flipper and targets which might equal, for example, 160 milliseconds. Thus, for an average ball we wait 160 milliseconds and then energize the flipper in order to have a good expectation of making the shot.

If the ball takes 130 milliseconds to pass through the optical beam, then it is going slower than the average ball and accordingly it is necessary to wait longer. This is ten milliseconds longer than the average ball. To compute the additional delay time, the ten milliseconds is multiplied by the scalar value. In the case of initial operation, the scalar is arbitrarily selected as 197/256. As indicated in FIG. 15, the scalar can change over time through the learning process. Using the initial scalar, however, yields a value of eight. This is added to the average delay time of 160 milliseconds to yield 168 milliseconds as the delay before the flipper is flipped.

Similarly, if the ball takes only 100 milliseconds to clear the opto beam, it is a fast moving ball and it is necessary to flip faster. The difference is twenty milliseconds which is multiplied by the scalar 197/256 to yield fifteen. The fifteen is subtracted from the average delay of 160 ms. to determine that the flipper should flip 145 milliseconds after the ball has cleared the beam.

From the foregoing description, it will be recognized that there is disclosed a system which, although it starts knowing nothing about the shot it is designed to perform, calibrates itself until it starts making the shot with some proficiency. Over time, if the game is moved to different locations or the game electro-mechanical components change, it will slowly change its timing to continue making the shot. If it should become lost, it will reinitialize to factory settings and again seek to calibrate and adapt to the new conditions based upon the three necessary parameters: the average ball velocity, the delay period required for the average ball, and the scalar used for non-average velocities.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. An automatic propelling feature for a rolling ball game having an inclined playfield and a ball which can roll thereon, the feature comprising:

a) targets intended to be hit by said ball;

b) processor means including memory for controlling operation of the game;

c) a ball propelling means, selectively controlled by the processor means, for shooting the ball at said targets;

d) means for signalling the processor means which, if any, targets are hit responsive to operation of the ball propelling means; and e) said processor means including means, responsive to the signalling means, for altering the timing of shots made by the ball propelling means under processor means control, thereby to improve and maintain the accuracy of the shots.

2. The feature of claim 1 wherein the ball propelling means is a flipper.

3. The feature of claim 2 further including means for determining ball speed as the ball approaches the flipper, said means for altering also being responsive to said means for determining ball speed.

4. The feature of claim 3 wherein said ball speed determining means includes optical detector means.

5. The feature of claim 4 further comprising a ramp from which said ball is delivered to said flipper, said optical detectors being located adjacent the delivery end thereof.

6. The feature of claim 3 wherein said altering means includes:

a) means for periodically determining the average ball speed over a selected number of samples;

b) means for computing a delay time for the average ball speed which is used to signal the processor means to flip the flipper;

c) means for adjusting the delay time to increase it for a ball moving slower than average and vice versa.

7. The feature of claim 6 wherein the means for adjusting the delay time includes means for scaling the delay time as a function of current ball speed and for periodically adjusting the scaling factor based on the information received from the signalling means associated with said targets.

8. The feature of claim 6 wherein the means for computing a delay time for the average ball speed includes:

a) an initial, "quick learn" mode, in which preselected delay times are tried until a target is hit;

b) a "normal" mode in which the delay time is periodically adjusted each time said selected number of samples has been obtained.

9. The feature of claim 1 wherein said targets include a primary target and at least two secondary targets for determining near misses.

10. The feature of claim 9 wherein said primary target is a drop-hole into which it is desired to sink the ball, said secondary targets being stand-up targets adjacent said drop-hole.

11. The feature of claim 1 wherein the means for signalling the processor means are switches associated with said targets.

12. A method for automatically operating a ball propelling means of a rolling ball game having an inclined playfield, a ball which can roll thereon and targets intended to be hit by said ball, the method comprising:

a) providing processor means including memory for controlling operation of the game;

b) permitting the processor to control said ball propelling means to shoot the ball at said targets;

c) signalling the processor which, if any, targets are hit responsive to the shot by the ball propelling means;

d) altering the timing used by the processor for its shots responsive to the signalling means, thereby to improve and maintain its aim.

13. The method of claim 12 further including the step of determining ball speed as the ball approaches the propelling means and whereby said step of altering the timing includes alteration to account for ball speed variation.

14. The method of claim 13 wherein said altering step includes:

a) periodically determining the average ball speed over a selected number of samples;

b) computing a delay time for the average ball speed which is used to signal the processor means to operate the propelling means;

c) adjusting the delay time to increase it for a ball moving slower than average and vice versa.

15. The method of claim 14 wherein the step of adjusting the delay time includes scaling the delay time as a function of current ball speed and for periodically adjusting the scaling factor based on the information received from the signals associated with said targets.

16. The method of claim 14 wherein the step of computing a delay time for the average ball speed includes:

a) employing an initial "quick learn" mode, in which preselected delay times are tried until a target is hit;

b) thereafter employing a "normal" mode in which the delay time is periodically adjusted each time said selected number of samples has been obtained.

* * * * *